US005927220A

United States Patent [19]

Zheng et al.

[11] Patent Number: 5,927,220

[45] Date of Patent: Jul. 27, 1999

[54] EMBROIDERY DATA PROCESSING FOR EXTRACTING CONTOUR OF AN EMBROIDERY PATTERN FROM STITCH DATA

[75] Inventors: Xiao Ming Zheng; Rui Zhang, both of Nagoya, Japan

[73] Assignee: Brother Kogyo Kabushiki Kaisha, Nagoya, Japan

[21] Appl. No.: 08/970,586

[22] Filed: Nov. 14, 1997

[30] Foreign Application Priority Data

Nov. 14, 1996 [JP] Japan ..... 8-302969
Nov. 20, 1996 [JP] Japan ..... 8-309570

[51] Int. Cl.[6] ..... D05C 5/02

[52] U.S. Cl. ..... 112/102.5; 112/475.19

[58] Field of Search ..... 112/102.5, 470.06, 112/456, 475.19; 364/470.09

[56] References Cited

U.S. PATENT DOCUMENTS 4,982,674 1/1991 Hayakawa ..... 112/470.06 X
4,991,524 2/1991 Ozaki ..... 112/470.06 X

*Primary Examiner*—Peter Nerbun
*Attorney, Agent, or Firm*—Oliff & Berridge, PLC

[57] ABSTRACT

An embroidery data process using a computer to extract stitch points from embroidery data and display the contours of an embroidery pattern to the user based on those stitch points. After the stitch points are extracted from the sewing data, an orthogonal coordinate system is defined by setting the first stitch point as the origin and the line formed from the first to the second stitch points as the X-axis. Then, using the first stitch point as the origin, the X components of the second and third stitch points are compared. If the X component of the second point is larger than that of the third, the second stitch point is determined to be a contour point. By continuing this process, all the contour points can be accurately extracted from the sewing data and displayed for the user. Also, to collect only the contour points, half stitch needle locations are detected. For example, for an array (Qi) of odd locations, the stitch point Qi+1 is determined to be the half stitch when a sign of the Y component of Qi+1 on an orthogonal coordinate system is in coincidence with a sign of the Y component of the stitch point in an array of even locations. The coordinate system is defined by setting Qi as the origin and the line formed from Qi to Qi+2 as the X-axis.

38 Claims, 13 Drawing Sheets

V = 0

V = 1

Vi+1 = 1

Vi+1 = 0

EMBROIDERY DATA PROCESSING FOR EXTRACTING CONTOUR OF AN EMBROIDERY PATTERN FROM STITCH DATA

BACKGROUND OF THE INVENTION

1. Field of the Invention

The present invention relates to an embroidery data processing device for processing embroidery data containing positional data representative of needle locations. More particularly, the invention relates to data processing for extracting a contour of an embroidery pattern from the embroidery data.

2. Description of the Related Art

Conventionally, embroidery sewing machines form embroidery patterns on a workpiece cloth based on embroidery data or stitch data. The embroidery data contains positional information about needle locations on the workpiece cloth. Recently, a variety of products with embroidery decorations are sold on the market. For making such products, it is convenient if the size of the embroidery pattern can easily be enlarged or reduced. However, when the size of the embroidery pattern is enlarged merely by increasing the spacing between the needle locations, the thread density becomes low and the base cloth will be seen from the spacing between thread segments. On the other hand, when the size of the embroidery pattern is reduced, the thread segments forming the embroidery pattern are tightly arranged. Such embroidery pattern is difficult to stitch.

One solution for enlarging or reducing the size of an embroidery pattern would be producing block data representative of the contour of the embroidery pattern based on the information about the needle locations contained in the embroidery data. The size of the contour is then changed as desired, and the enlarged or reduced contour is converted back to the positional data in which the needle locations are set on the contour at a predetermined interval so that the resultant embroidery pattern has a predetermined thread density. In actuality, however, converting the positional information into block data is extremely difficult. To date, no technology is available which can perform this conversion with sufficient precision.

Here, an example of a conventional block data technique will be provided. An arc shaped embroidery pattern, such as shown in FIG. 16(*b*), has an inner side contour R and an outer side contour R'. To insure that the thread density is substantially equal near both the inner and outer sides of the embroidery pattern, half stitch needle locations Q are usually set near the inner side contour R. However, in the conventional block data technique, the half stitch needle locations cannot be distinguished from contour points forming a contour of the embroidery pattern. With such a conventional technique, positional information shown in FIG. 16(*a*) will result in the block data shown in FIG. 16(*b*). As such, converting the positional information into block data is not sufficiently precise with the conventional technology.

SUMMARY OF THE INVENTION

In view of the foregoing, it is an object of the present invention to provide an embroidery data processing device which can extract a contour of an embroidery pattern from embroidery data. The present invention also provides a method of extracting a contour of an embroidery pattern from embroidery data.

Another object of the present invention is to provide an embroidery data processing device which can detect half stitch needle locations with high precision and a method for detecting these half stitch needle locations.

To achieve the above and other objects, there is provided, according to one aspect of the invention, an embroidery data processing device that includes orthogonal coordinate system setting means, comparison means, and needle location discriminating means. The orthogonal coordinate system setting means is provided for setting an orthogonal coordinate system having an X axis and a Y axis orthogonal to the X axis. The X axis is defined by a line formed from a needle location Pi to a needle location Pi+1. The needle location Pi is set as an origin of the orthogonal coordinate system. Here, i is a natural number. The comparison means is provided for comparing an X component on the orthogonal coordinate system of the needle location Pi+1 with an X component on the orthogonal coordinate system of the needle location Pi+2. The needle location discriminating means is provided for determining the needle location Pi+1 to be a contour point forming a contour of an embroidery pattern when comparison results indicate that the X component of the needle location Pi+1 is larger than the X component of the needle location Pi+2. In the embodiment described in the flowchart of FIG. 2, the process in S9 corresponds to the orthogonal coordinate system setting means, the process in S11 to the comparison means, and the process in S13 to the needle location discriminating means.

The embroidery pattern is formed based on embroidery data containing positional data of each needle position. Setting of the orthogonal coordinate system by the orthogonal coordinate system setting means, comparison by the comparison means, and determination by the needle location discriminating means are repeatedly performed while consecutively increasing the natural number n up to a predetermined natural number defined by the embroidery data to form the contour. Display means is further provided for displaying the contour.

When the needle location discriminating means determines that the needle location Pi and the needle location Pi+2 are also the contour points when the needle location Pi+1 is determined to be the contour point, the needle location discriminating means determines that the needle location Pi+1 has a satin attribute. When the needle location discriminating means determines that either the needle location Pi or the needle location Pi+2 is not a contour point when the needle location Pi+1 in determined to be the contour point, the needle location discriminating means determines that the needle location Pi+1 has a tatami attribute.

The embroidery data processing device may further include Y component computing means and discrimination correcting means. The Y component computing means is provided for computing a Y component of the needle location Pi+2 on the orthogonal coordinate system used for determining if the needle location Pi+1 is the contour point. The discrimination correcting means is provided for correcting the determination made by the needle location discriminating means so that the needle location Pi+1 having been determined as the contour point in not the contour point when a sign of the Y component of the needle location Pi+2 computed by the Y component computing means is in coincidence with at least one of signs of Y components computed by the Y component computing means on orthogonal coordinate systems used for determining if needle locations adjacent to the needle location Pi+1 are the contour point.

Block forming means may further be provided for forming block shapes representative of the contour of the embroidery pattern. Each of the block shapes has two opposing sides, and each of the two opposing sides is defined by connecting every other contour points with a line segment. Preferably, the block forming means forms the block shapes based on the contour points which remain as a result of correction by the discrimination correcting means.

The embroidery data processing device may further include thread density calculating means and needle location classifying means. The thread density calculating means is provided for calculating a thread density around each needle location. The needle location classifying means is provided for classifying the needle locations according to the thread density. The block forming means forms a block shape according to the needle locations falling into the same classification.

According to another aspect of the present invention, there is provided an embroidery data processing device that includes line setting means, and half stitch determining means. This device is used for processing the embroidery data containing information about needle locations such that the needle locations form a zig-zag pattern when sequentially connecting consecutively numbered needle locations with a line segment. Here, i is a natural number. The line setting means is provided for setting a first line connecting i-th needle location and (i+4)th needle location. The half stitch determining means is provided for determining that (i+2)th needle location is a half stitch needle location when the (i+2)th needle location is inside an area defined by the first line and a second line connecting (i+1)th needle location and (i+3)th needle location.

The half stitch determining means determines that the (i+2)th needle location is the half stitch needle location only when the (i+2)th needle location is apart by a predetermined distance from the first line. The predetermined distance may be determined based on a thread density of the embroidery and/or a line shape formed by connecting needle locations around the (i+2)th needle location.

The embroidery data processing device may further include orthogonal coordinate system matting means, Y component computing means, and direction determining means. The orthogonal coordinate system setting means is provided for setting an orthogonal coordinate system having an X axis and a Y axis orthogonal to the X axis. The X axis is defined by a line formed from the i-th needle location to the (i+4)th needle location. The i-th needle position is set as an origin of the orthogonal coordinate system. The Y component computing means is provided for computing a Y component of (i+3)th needle location on the orthogonal coordinate system set by the orthogonal coordinate system setting means. The direction determining means is provided for determining whether or not a direction in which the Y axis extends is toward the (i+1)th needle location or (i+3)th needle location. The half stitch determining means determines whether the (i+2)th needle location is the half stitch needle location or not based on the Y component computed by the Y component computing means and the determination made by the direction determining means. Specifically, the half stitch determining means determines that the (i+2)th needle location is the half stitch needle location when the Y component computed by the Y component computing means is a positive value and a direction in which the Y axis extends is toward the (i+1)th needle location or (i+3)th needle location. The half stitch determining means also determines that the (i+2)th needle location is the half stitch needle location when the Y component computed by the Y component computing means is a negative value and a direction in which the Y axis extends is away from the (i+1)th needle location or (i+3)th needle location.

The line setting means includes first line setting means and second line setting means. The first line setting means is provided for setting the first lines while incrementing the natural number i by two. When the i-th needle location has been determined as the half stitch needle location by the half stitch determining means, the first line is set using (i−2k)th needle location instead of the i-th needle location wherein the (i−2k)th needle location is a firstly appearing contour point when observing the needle locations in a backwards direction while decrementing i by two. Here, k is a natural number. The second line setting means is provided for setting the first lines while decrementing the natural number i by two. When the (i+4)th needle location has been determined as the half stitch needle location by the half stitch determining means, the first line is set using (i+4+2k)th needle location instead of the (i+4)th needle location wherein the (i+4+2k)th needle location in a firstly appearing contour point when observing the needle locations in a forward direction while incrementing i by two. The half stitch determining means determines that the (i+2)th needle location is the half stitch needle location when the (i+2)th needle location is inside an area defined by the first line set either the first line setting means or the second line setting means and the second line connecting the (i+1)th needle location and the (i+3)th needle location.

BRIEF DESCRIPTION OF THE DRAWINGS

The particular features and advantages of the invention as well as other objects will become apparent from the following description taken in connection with the accompanying drawings, in which:

FIG. 5(*b*) is also an explanatory diagram showing the principles used in the contour data detection process to detect contour points;

FIG. 7(*b*) is an explanatory diagram showing a line/block creating process for the embroidery data shown in FIG. 7(*a*);

FIG. 10(*b*) is an explanatory diagram exemplifying another method of setting a direction flag V;

FIG. 11(*b*) is an explanatory diagram exemplifying another method of setting a direction flag Vi+1;

FIG. 13(*b*) is an explanatory diagram also illustrating the block data creating routine shown in the flowchart of FIG. 8;

FIG. 13(*c*) is an explanatory diagram further illustrating the block data creating routine shown in the flowchart of FIG. 8;

FIG. 16(*b*) is an explanatory diagram also illustrating the problems involved in the prior art.

DETAILED DESCRIPTION OF THE PREFERRED EMBODIMENTS

Figure 1:
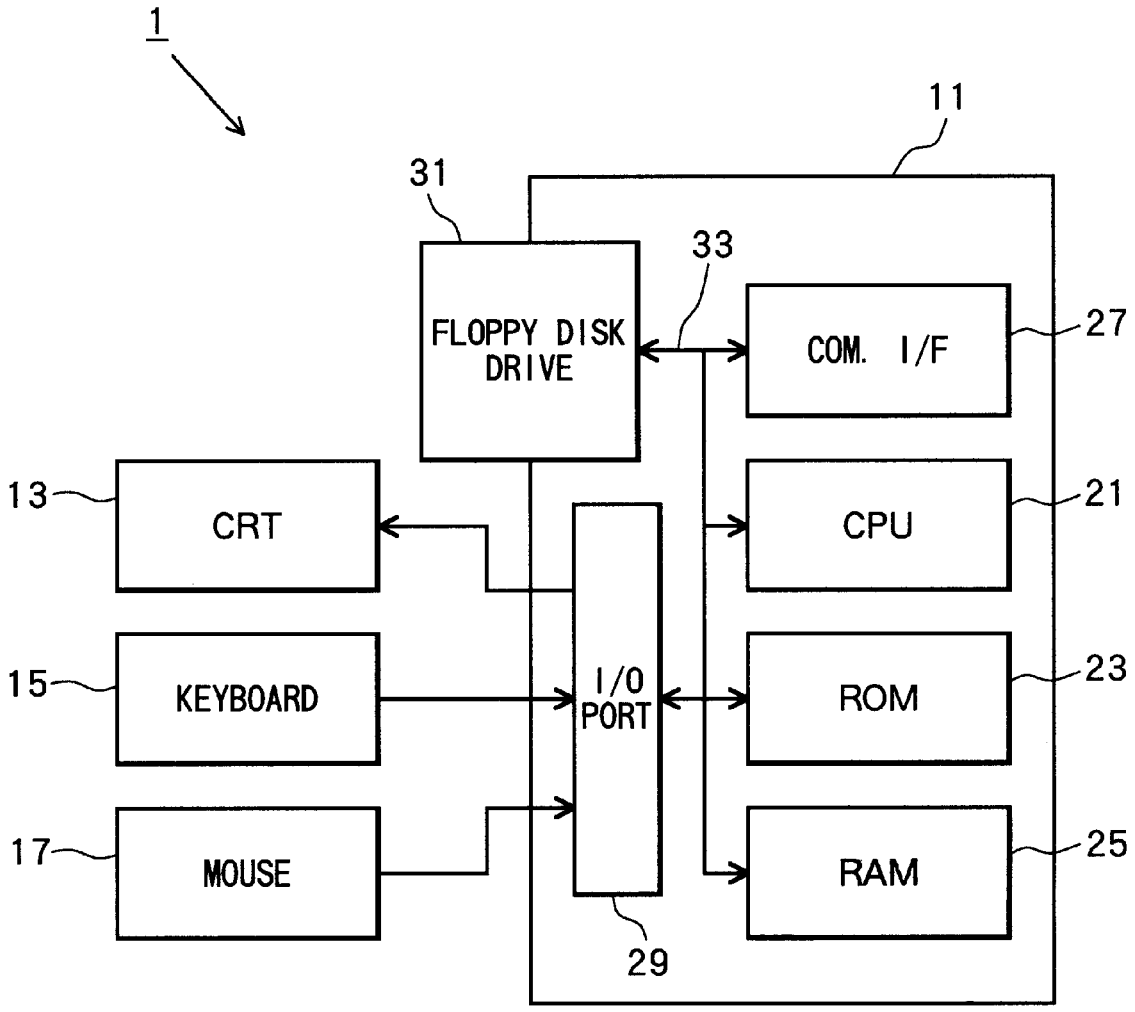
FIG. 1 is a block diagram showing the general structure of a personal computer applied to the present invention.

Preferred embodiments of the present invention will be described with reference to the accompanying drawings. FIG. 1 is a block diagram showing a personal computer (hereinafter referred to an a "PC") serving as an embroidery data processing device to which the present invention is applied. In the following description, the term "needle location" is intended to mean a location or point on a workpiece cloth stitched or to be stitched by a needle. The term "stitch point" will also be used instead of the term "needle location" as an equivalence of "needle location".

As shown in FIG. 1, the PC 1 includes 13, keyboard 15, and mouse 17 in addition to a PC body 11. The PC body 11 includes a CPU 21, RON 23, RAM 25, communication interface 27, input/output port 29, and floppy disk drive 31. The communication interface 27 in used to communicate with an embroidery sewing machine and other data processing devices. The input/output port 29 inputs data from and outputs data to the CRT 13, keyboard 15, and mouse 17. The floppy disk drive 31 is used to write data in floppy disks and read data therefrom. The CPU 21, ROM 23, RAM 25, communication interface 27, input/output port 29 and floppy disk drive 31 are connected via bus 33 for data transmission and reception.

Figure 2:
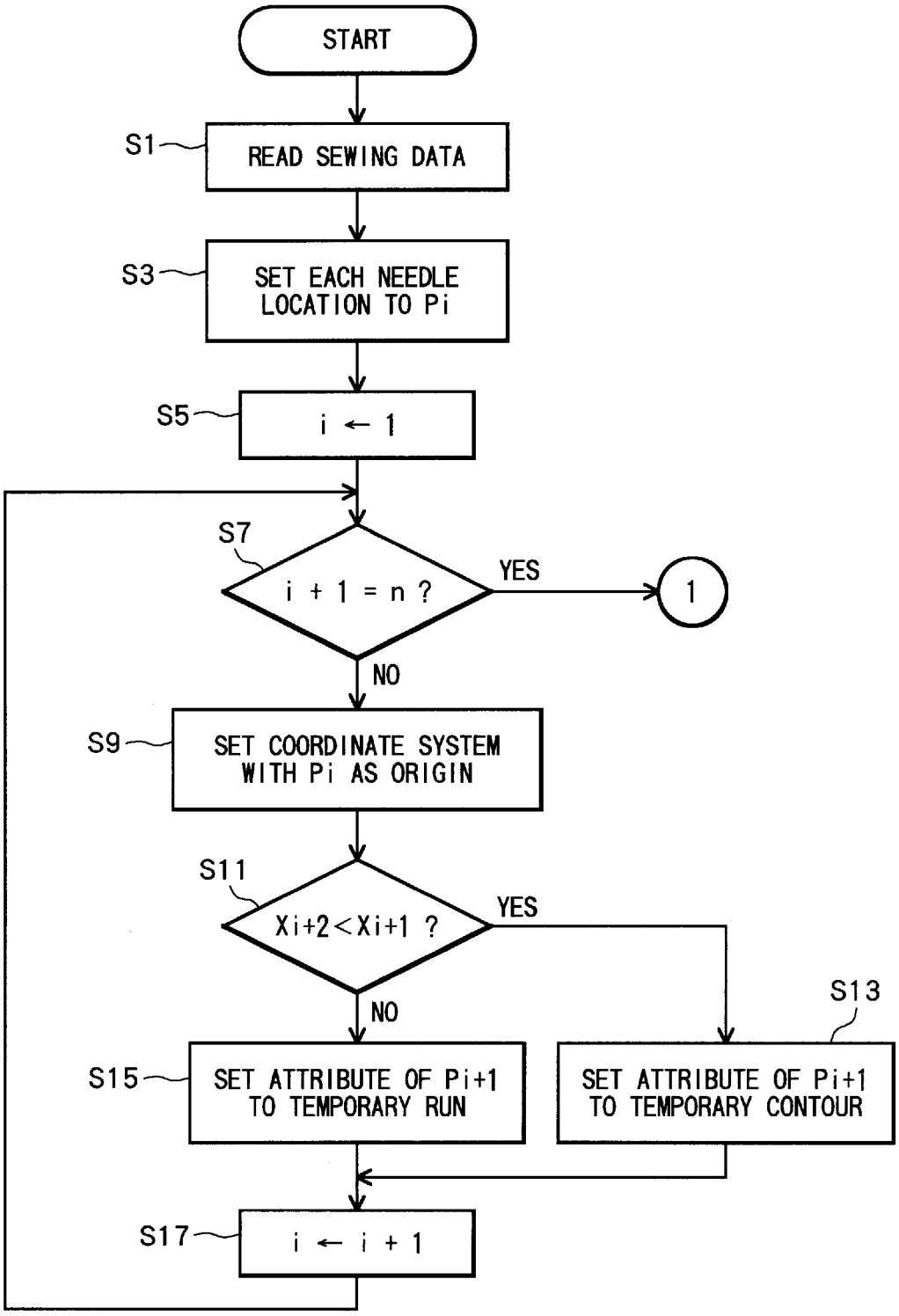
FIG. 2 is a flowchart showing a contour data detection process executed by the personal computer.
Figure 3:
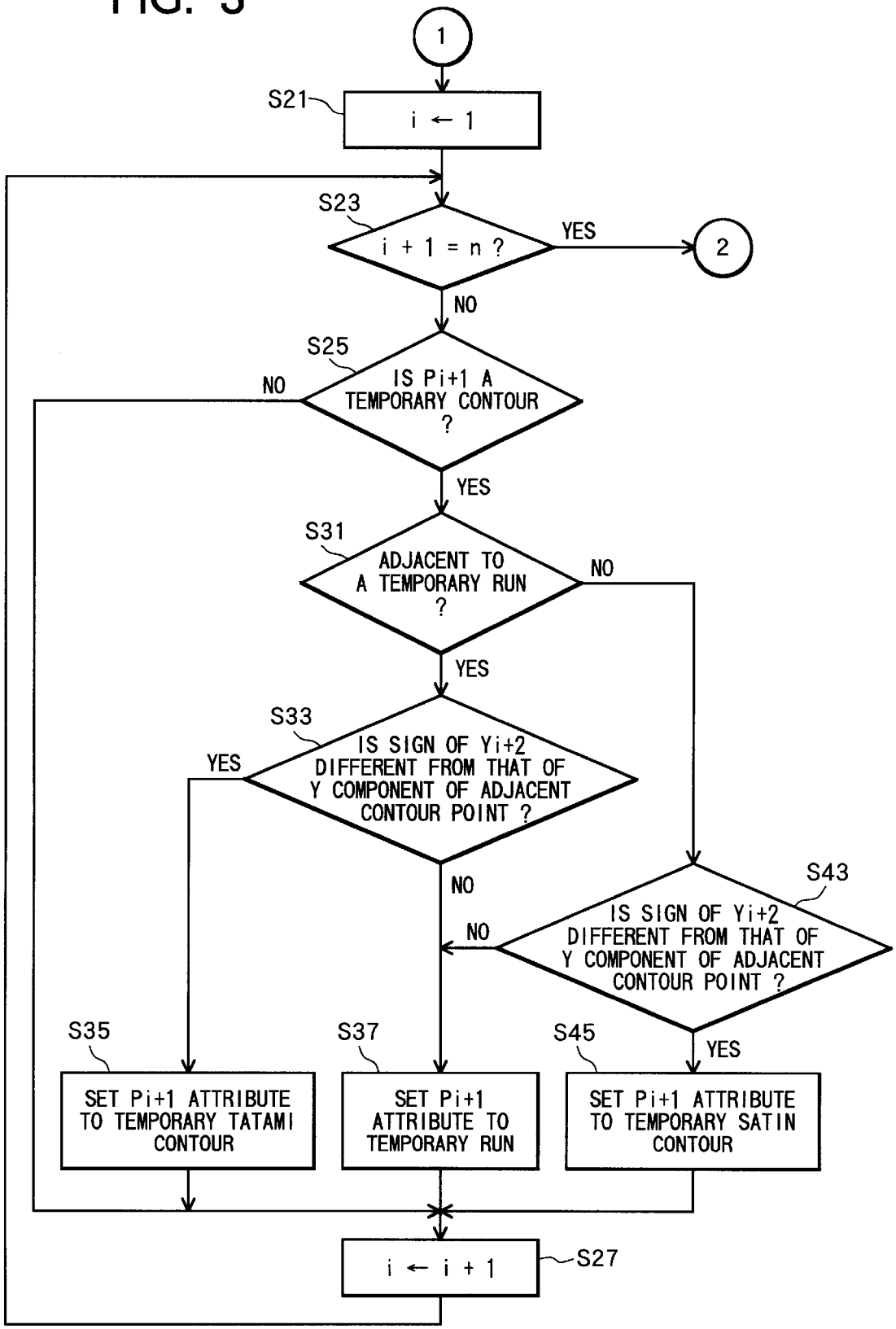
FIG. 3 is a continuation of the flowchart in FIG. 2.
Figure 4:
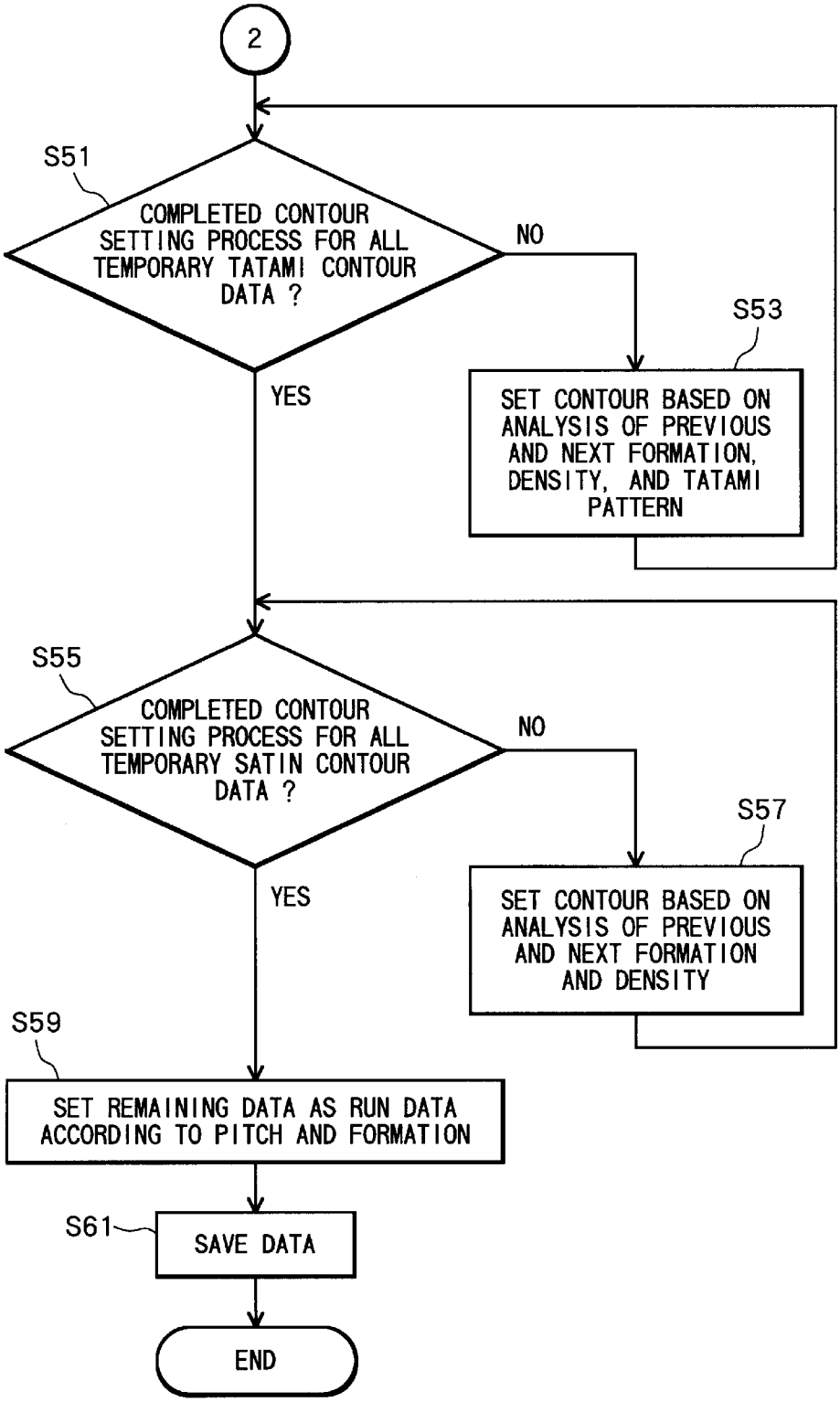
FIG. 4 is a continuation of the flowchart in FIG. 3.

Next, a contour data detection processing executed by the CPU 21 will be described while referring to the flowcharts shown in FIGS. 2 through 4. The CPU 21 executes the contour data detection process based on the program stored in the ROM 23 when a prescribed input is entered from the keyboard 15 or the mouse 17. Before execution of the process, a floppy disk containing sewing data (embroidery data) must be inserted into the floppy disk drive 31.

At the beginning of the process, sewing data is read from the floppy disk via the floppy disk drive 31 in S1 (S represents "step" here and hereinafter). Stitch data containing coordinates for each needle location on a workpiece cloth in the sewing order is used as the sewing data. In S3, each needle location stored in the sewing data is set to Pi, such that i=1, 2, . . . , n, where i indicates the place of the needle location in the sewing order and n is the total number of needle locations. In S5, i is set to 1, and it is determined in S7 whether i+1=n. Since i+1=2 at the beginning of this process, ordinarily the result of the determination will be "no."

Figure 5:
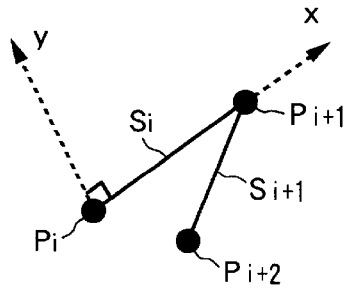
FIG. 5(*a*) is an explanatory diagram showing the principles used in the contour data detection process to detect contour points.
Figure 5:
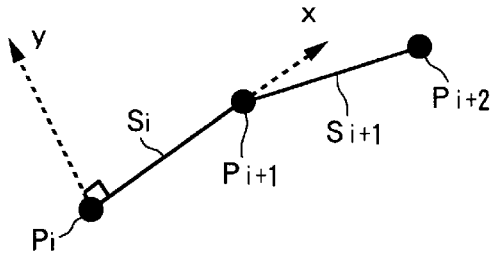

In S9, an orthogonal coordinate system is established with the needle location Pi as the point of origin using the following method. As shown in the examples of FIGS. 5(*a*) and 5(B), the X-axis is set as the direction from the needle location Pi to the needle location Pi+1. The Y-axis is established by rotating this X-axis 90° about the needle location Pi in the counterclockwise direction. Also in S9, the coordinates for the needle location Pi+1 (Xi+1, 0) and the needle location Pi+2 (Xi+2, Yi+2) are read and stored in a specified area of the RAM 25.

In S11, the values for Xi+1 and Xi+2 read in S9 are compared. If Xi+1 is larger, S13 is executed. However, if Xi+2≧Xi+1, S15 is executed. In S13, the attribute of the needle location Pi+1 is set to a "temporary contour," but in S15, the attribute of the needle location Pi+1 is set to a "temporary run."

A contour point, as in the example of Pi+1 of FIG. 5(*a*) in a point at which the stitch returns, that is, reverses directions, after passing through the point. Hence, the stitch segment Si+1 forms an acute angle with the segment Si, and, therefore, the value of Xi+2 is smaller than the value of Xi+1 ("yes" in S11), and the attribute of Pi+1 is set to a temporary contour in S13, indicating an assumption that the needle location Pi+1 is a contour point.

Conversely, with a run point, as in the example of Pi+1 in FIG. 5(*b*), the stitch segment Si+1 forms an obtuse angle with the segment Si, and, therefore, the value of Xi+2 is greater than or equal to the value of Xi+1 ("no" in S11), and the attribute of Pi+1 is set to a temporary run in S15, indicating an assumption that the needle location Pi+1 is a run point. The needle locations Pl and Pn are automatically assigned the attribute of temporary run.

In S17, the variable i is incremented by 1 and the process is repeated from S7. Hence, the processes in S7–S17 are repeated as i is incrementally increased. Then, when i+1=n ("yes" in S7), indicating that the attributes for all the needle locations Pi+1, such that i+1=2, 3, . . . , n−1, have been set to either a temporary contour or a temporary run in S13 and S15, then the process beginning from S21 is executed to further sort the needle locations Pi+1 whose attributes were set to temporary contours in the above-described process.

First, 1 is initialized to 1 in S21. It in determined in S23 whether i+1=n. If i+1=n ("no" in S23), then it is determined in S25 whether the attribute of the needle location Pi+1 is a temporary contour. If Pi+1 is not a temporary contour ("no" in S25), then i is incremented by 1 in S27 and the process in S23 is repeated.

However, if the needle location Pi+1 is a temporary contour ("yes" in S25), it is determined in S31 whether the needle location Pi+1 is adjacent to a needle location assigned with a temporary run attribute, that is, if either the needle locations Pi or Pi+2 is a temporary run. If the needle location Pi+1 is adjacent to a temporary run ("yes" in S31), then the value Yi+2 for the needle location Pi+1, which was stored in S9 in the attribute assignment loop, is read. Also, the corresponding values with respect to the needle locations having a temporary contour attribute and positioned before and after the needle location Pi+1 are read, and of the values thus read is compared with the value Yi+2 to determine whether the signs of the values subject to comparison are different. If these two Yi+2 values (as obtained in S9) have different signs ("yes" in S33), then S35 is executed, otherwise ("no" in S33) S37 is executed. In S35, the attribute of the needle location Pi+1 is set to a temporary tatami contour. In S37, the attribute is set to a temporary run.

In most cases, contour points form two opposing sides on either side of an embroidery pattern. Here, stitches form a zigzag between opposing contour points. Further, the return direction of the stitch alternates between each contour point. Therefore, the sign of the Yi+2 value also alternates between each contour point. When needle locations (run points) exist between opposing contour points, the stitch is referred to as a tatami stitch. When needle locations do not exist between opposing contour points, the stitch is referred to as a satin stitch.

Hence, in the process described above, when the temporary contour needle location Pi+1 is adjacent to a temporary run needle location ("yes" in S31) and the sign of Yi+2 alternates with that of the temporary contour needle location before and after the needle location Pi+1 ("yes" in S33), the needle location Pi+1 is reset to a temporary tatami contour in S35. However, when the sign of Yi+2 does not alternate with that of the temporary contour needle location before and after the needle location Pi+1 ("no" in S33), the attribute of the needle location Pi+1 set in S13 is modified to a temporary run in S37.

On the other hand, if the temporary contour needle location Pi+1 is not adjacent to a temporary run needle location ("no" in S31), then the sign of Yi+2 in compared in S43 in the same manner as in S33. If the sign of Yi+2 alternates with that of the temporary contour needle location before and after the needle location Pi+1 ("yes" in S43), the needle location Pi+1 is reset to a temporary satin contour in S45, and i is incremented in S27. However, when the sign of Yi+2 does not alternate with that of the temporary contour needle location before and after the needle location Pi+1 ("no" in S43), the attribute of the needle location Pi+1 set in S13 is modified to a temporary run in S37, described above, and i is incremented in S27. These processes S23–S45 are repeatedly executed until i+1=n ("yes" in S23), at which time the process of S51 is performed.

In S51, it is determined whether the contour setting process has been completed for all needle location data assigned with a temporary tatami contour attribute. In the first execution of this process, the contour setting process has not been completed ("no" in S51), and a process to set contours of the embroidery pattern is executed in S53 based on analyzing the previous and next needle location formations, the thread density (distance between every other contour point), and the tatami pattern. The steps S51 and S53 are repeatedly executed until all needle location data assigned with a temporary tatami contour attribute has been processed ("yes" in S51).

In S55, it is determined whether the contour setting process has been completed for all needle location data assigned with a temporary satin contour attribute. In the first execution of this process, the contour setting process has not been completed ("no" in S55), and the process to set a contour of the embroidery pattern is executed in S57 based on analyzing the previous and next needle location formations, the thread density, and the like. The steps S55 and S57 are repeatedly executed until all needle location data assigned with a temporary satin contour attribute has been processed ("yes" in S55).

In S59, the remaining needle location data not set to contours in S53 and S57 are set as run points according to their pitch and formation. In S61, the data set in the steps above is saved onto a floppy disk via the floppy disk drive 31, and the process ends.

Next, as an example of the contour setting process executed in S53 and S57, a routine for creating block data based on the thread density of the needle locations will be described with reference to the flowchart of FIG. 6. In addition to this process, other detailed processes are performed in S53 and S57 based on the form of the previous and next needle locations.

Figure 6:
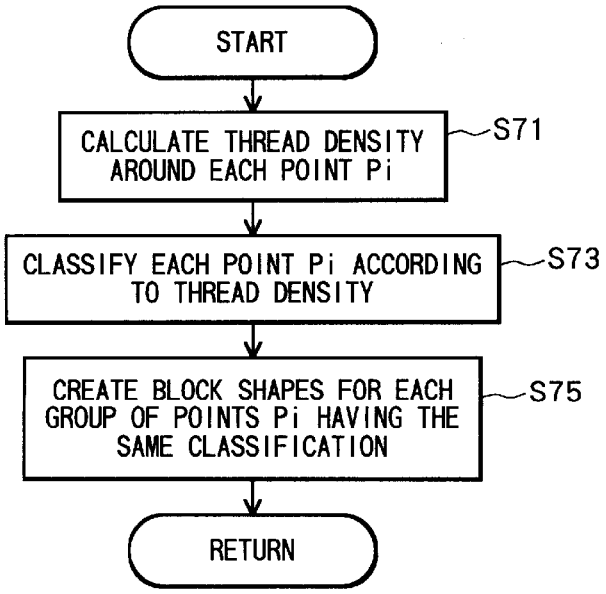
FIG. 6 is a flowchart showing a block data creating routine of the embroidery data process according to a first embodiment of the present invention.

In S71 at the beginning of the process in FIG. 6, the thread density around each needle location Pi is calculated. In S73, the needle locations Pi are classified according to thread density and formed into block shapes in S75 grouped according to these classifications, after which the remaining processes included in S53 and S57 are executed. The process of forming groups of needle locations Pi into block shapes is performed by connecting every other temporary contour needle location with a line segment and repeating the process for the opposing side of the embroidery pattern.

Figure 7:
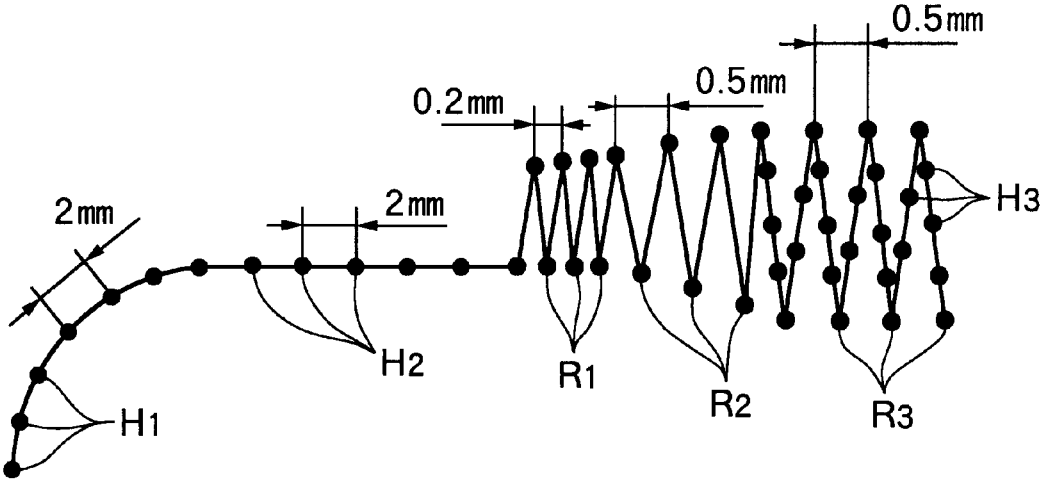
FIG. 7(*a*) is an explanatory diagram showing examples of the embroidery data.
Figure 7:
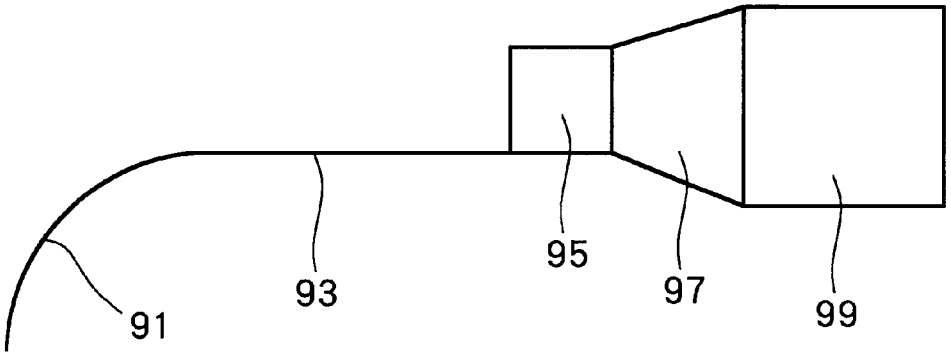

An example of this process is shown in FIG. 7. The black dots of FIG. 7(*a*) represent sewing data needle locations. The sewing data of this example includes run points H1 spaced 2 millimeters apart and formed in an arc; run points H2 spaced 2 millimeters apart and formed in a straight line; satin contour points R1 spaced 0.2 millimeters apart; satin contour points R2 spaced 0.5 millimeters apart; and tatami contour points R3 spaced 0.5 millimeters apart. Further, run points H3 are positioned between opposing tatami contour points R3.

The classifications of run points H1–H3 and contour points R1–R3, and further classifications of satin contour points R1 and R2 and tatami contour points R3, are executed in the processes of S3–S45. in S59, the run points H1 are set as a curving line with a pitch of 2 millimeters; the run points H2 are not as a straight line with a pitch of 2 millimeters; and the curved line 91 and straight line 93 shown in FIG. 7(*b*) are created, in the process of S73, executed during S57, contour points R1 and R2 are classified according to the interval between every other point (thread density) and set as satin contour points having thread intervals of 0.2 millimeters and 0.5 millimeters, respectively. In the process of S75, blocks 95 and 97 corresponding to these groups of points are formed. In the process of S53, the contour points R3 are set as tatami contour points having a thread interval of 0.5 millimeters, and block 99 is created.

Data such as that shown in FIG. 7(*b*) is saved in S61. In routines not shown in the drawings, the CPU 21 displays on the CRT 13 the image data shown in the example of FIG. 7(*a*), after executing the process of S1 shown in FIG. 2, and the image data shown in the example of FIG. 7(*b*), after executing the process of S59 shown in FIG. 4.

As described above, needle locations are classified as either temporary contour or temporary run through the extremely easy process of establishing an orthogonal coordinate system and comparing the X-axis segment of points in S9 and S11. Then, the results of that classification are corrected by comparing the Y-axis segments of the points in S33 and S43. As a result, the user can easily and accurately learn the contours of the embroidery pattern corresponding to the sewing data.

As described above, temporary contour needle locations are further classified as satin or tatami and according to thread density, and the blocks 95–99 are created for each classified group of needle locations. As a result, block shapes representing in detail the characteristics of the embroidery pattern can easily and accurately be created. Further, this block data can be accurately enlarged, shrunk, or transformed, or converted to stitch data according to the above-described thread densities and attributes.

The embroidery data process device as described above can be incorporated in the embroidery sewing machine. Further, when the sewing data includes color changing codes instructing the thread color to be changed, it is possible to configure the sewing machine to create and display blocks for each thread color.

As another example of the contour setting process executed in S53 and S57, a routine for creating block data will be described with reference to the flowcharts of FIGS. 8 and 9. This routine creates block data that represents an accurate contour of an embroidery pattern. The block data is created without incorporating the half stitch needle locations. In addition to this procese, a more detailed process is executed in S53 and S57 based on the formation of the previous and next needle locations. Further, this routine for creating block data can either be executed in both S53 and S57 or in just one of the steps.

Figure 8:
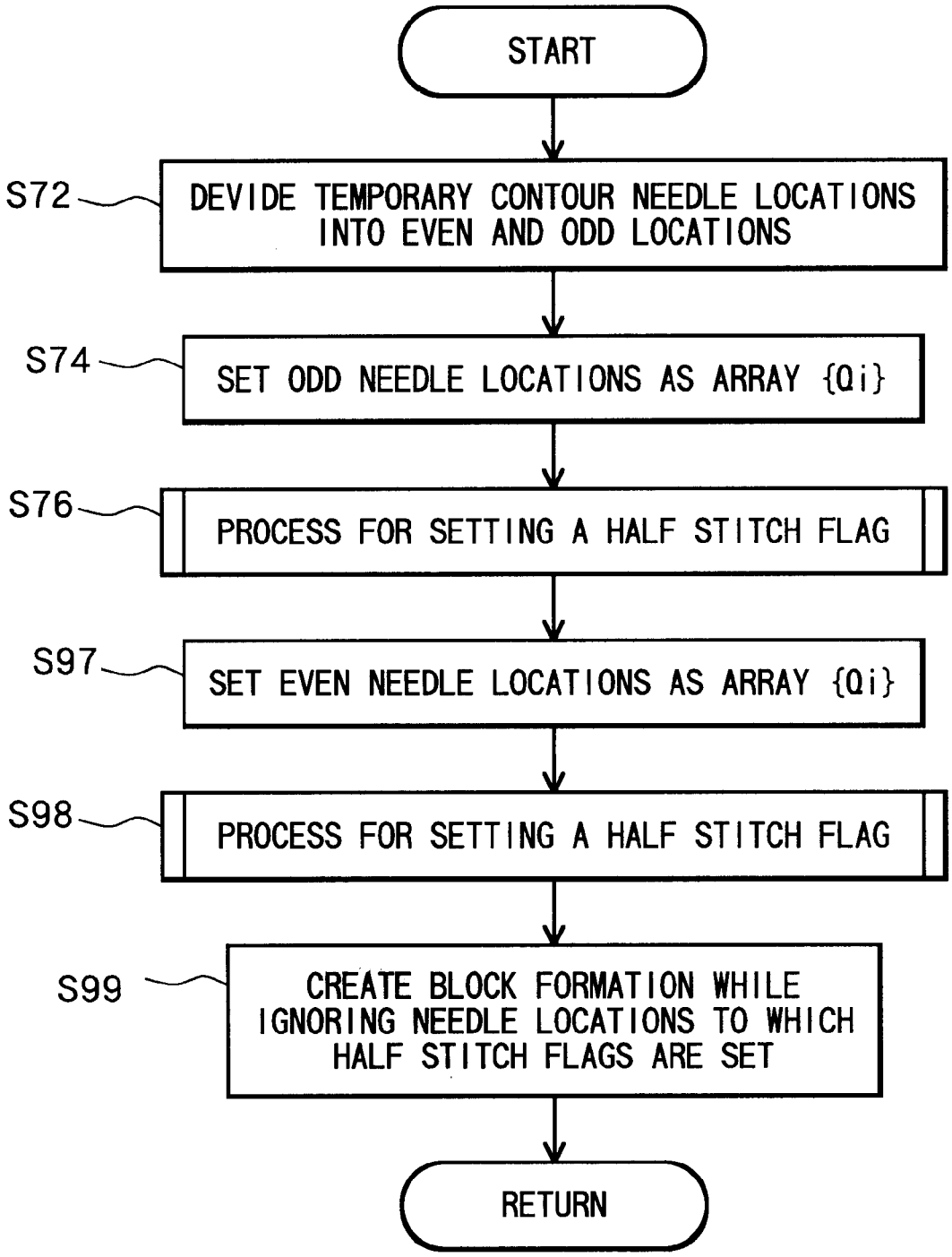
FIG. 8 is a flowchart showing a block data creating routine of the embroidery data process according to a second embodiment of the present invention.

At the beginning of the routine shown in FIG. 8, the needle locations assigned with a temporary contour attribute in the above-described process are divided into even and odd locations in S72. The odd needle locations are set as the array {Qi} in S74, such that i equals the sewing sequence 1, 2, . . . . In S76, a process for setting a half stitch flag is executed.

Figure 9:
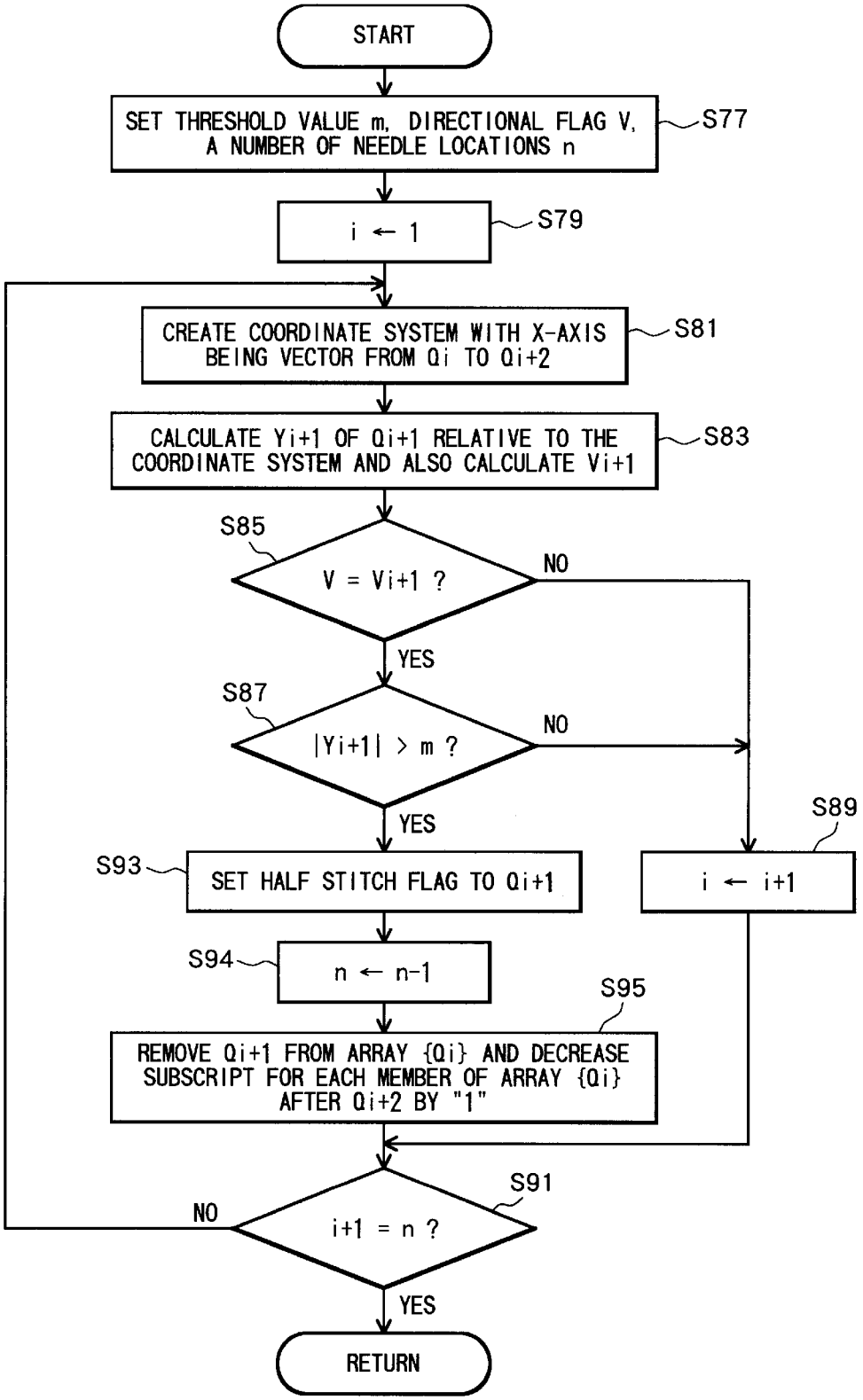
FIG. 9 is a flowchart showing a half stitch flag setting routine of the embroidery data process according to the second embodiment of the present invention.

As shown in the flowchart of FIG. 9, the process for setting a half stitch flag begins by setting a threshold value m, a directional flag V, and a number of needle locations n in S77. When the array {Qi} is arranged on the inner side of an arc-shaped embroidery pattern, there exists a needle location Qi such that Qi is inside (toward the even side, in this case) the line connecting Qi−1 to Qi+1, even when the needle location Qi is a contour point. In S77, therefore, the threshold value m is not to a value appropriate for distinguishing between half stitch needle locations and contour points based on the thread density and formation of the previous and next needle locations. In addition, n is set to the number of elements in the array {Qi}, and the directional flag V is set according to the process described below.

Figure 10:
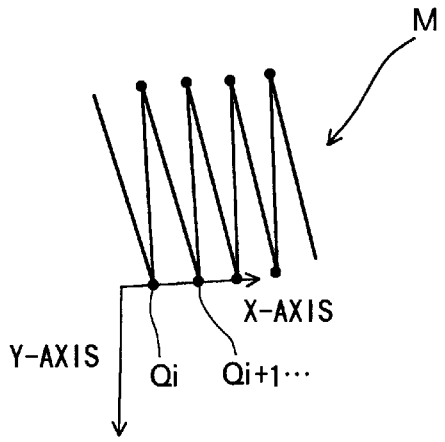
FIG. 10(*a*) is an explanatory diagram exemplifying a method of setting a direction flag V.
Figure 10:
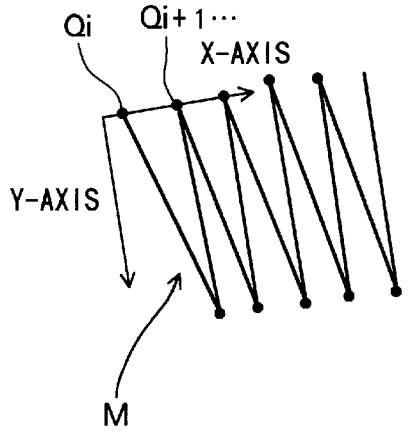
Figure 11:
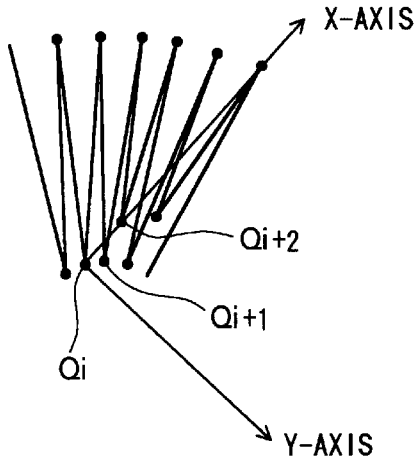
FIG. 11(*a*) is an explanatory diagram exemplifying a method of setting a direction flag Vi+1.
Figure 11:
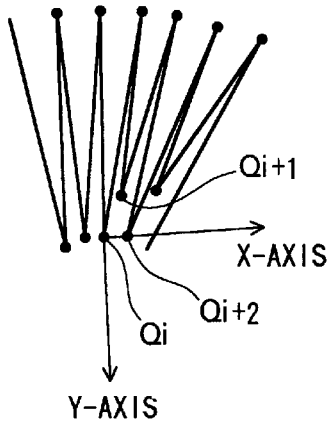

As will be described later, an orthogonal coordinate system is established in this routine with an X-axis along the array {Qi}. The directional flag V is set according to which direction the Y-axis of the orthogonal coordinate system is pointing in relation to the embroidery pattern (in this case, in relation to the even needle locations). For example, when the Y-axis is pointing in the direction opposite to the embroidery pattern M, as shown in the example of FIG. 10(*a*), the directional flag V is set to 0, and when the Y-axis is pointing toward the embroidery pattern M, as shown in the example of FIG. 10(*b*), the directional flag V is set to 1.

Next, i is set to 1 in S79. In S81, an orthogonal coordinate system is created with the needle location Qi as the point of origin and the vector in the direction from Qi to Qi+2 as the X-axis. In S83, the Y coordinate Yi+1 of the needle location Qi+1 relative to the current coordinate system is calculated, as well as the directional flag Vi+1. Here, the directional flag Vi+1 is set to 1 when the Y coordinate Yi+1 is positive and is set to 0 when Yi+1 is negative.

In S85, the directional flag V is compared with the directional flag Vi+1. Further, in S87, the absolute value of Yi+1 is compared with the threshold value m. If the needle location Qi+1 is a half stitch, then V=Vi+1 ("yes" in S85), and |Yi+1|>m ("yes" in S87), because the needle location is further inside the embroidery pattern than the threshold value m.

If it is determined that V does not equal Vi+1 ("no" in S85) or the absolute value of Yi+1 in not greater than m ("no" in S87), then it is determined that the needle location Qi+1 is not a half stitch, whereupon i is incremented by 1 in S89. If i+1 is not equal to n ("no" in S91), the process is repeated from S81.

However, it the determinations in both S85 and S87 are "yes," indicating the needle location Qi+1 is a half stitch, then a half stitch flag is set for the needle location Qi+1 in S93. Next, n in decremented 1 in S94. In S95, the needle location Qi+1 is removed from the array {Qi}, and the subscript for each member of the array {Qi} beginning from Qi+2 is decreased by 1. In other words, Qi+2, Qi+3, . . . will become Qi+1, Qi+2, . . . . As described above, if i+1 does not equal n ("no" in S91), then the process from S81 is repeated.

The effects of this process will be described next. In the example shown in FIG. 12, the half stitch needle locations Qi+1 and Qi+2 are successive and the needle location Qi+1 is deeper inside than the needle location Qi+2. In such a case, it is possible to detect that the needle location Qi+1 is a half stitch in S93 by setting an X-axis 51 in a direction of the vector from Qi to Qi+2 in S81. However, if an X-axis 53 is set in a direction from Qi+1 to Qi+3, then the needle location Qi+2 will not be detected as a half stitch.

Therefore, when the needle location Qi+1 in a half stitch, Qi+1 is removed from the array {Qi} and all subsequent needle locations are moved back one place in the array {Qi} in S95. At this time, S89 is not executed, so that the next time S81 is executed, an X-axis 55 will be set from Qi to the former Qi+3 (now Qi+2), and the former Qi+2 (now Qi+1) can be detected as a half stitch. The half stitch flags that are set in S93 are stored in the RAM 25 corresponding to the needle locations Pi set in S3. For this reason, the needle locations corresponding to the half stitch flags will not change even when the subscripts are changed in S95.

S81–S95 are repeated for every needle location Qi+1, such that 2≦i+1≦n−1, to determine with S85 and S87 whether each needle location is a half stitch. When i+1 equals n ("yes" in S91), control returns to the process of FIG. 8. If the needle location Qi+1 when i+1=n−1 in not a half stitch, i is incremented by 1 in S89 so that the determination of S91 is "yes." If Qi+1 when i+1=n−1 is a half stitch, n in decremented by 1 in S94 so that the determination of S91 is "yes."

In S97 of FIG. 8, the array {Qi} is set to the even needle locations, and in S98 the process for setting half stitch flags of FIG. 9 is repeated using the new array. In S77, the directional flag V is usually changed, and the threshold value m is changed to suit the arrangement of the array {Qi}. After the process for setting half stitch flags of S98 is completed, a block formation is created in S99 by connecting all the adjacent odd contour needle locations and all the adjacent even contour needle locations with line segments, while ignoring the needle locations to which half stitch flags are set.

Figure 13:
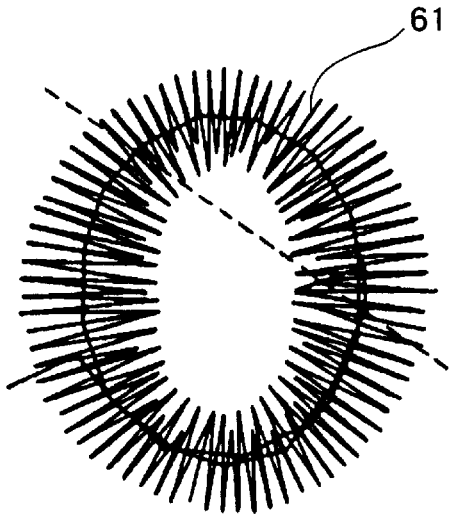
FIG. 13(*a*) is an explanatory diagram exemplifying an example of the block data creating routine.
Figure 13:
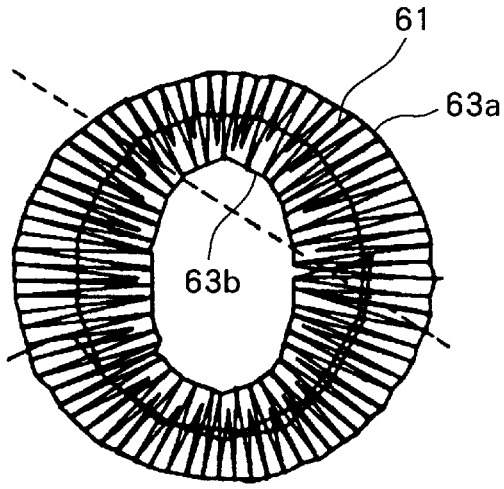
Figure 13:
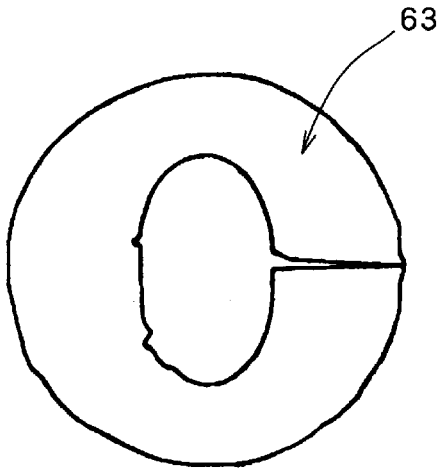

FIGS. 13(*a*)–13(*c*) show how the block data described above is created. An example of stitch data 61 is shown in FIG. 13(*a*). Using the stitch data 61, contours 63*a* and 63*b*, shown in FIG. 13(*b*), are established in the process described above by ignoring the half stitch needle locations, forming a block outline 63, as shown in FIG. 13(*c*). The desired diagrams from FIGS. 13(*a*)–(*c*) can be displayed on the CRT 13 according to input from the keyboard 15 or the mouse 17.

As described in the embodiment above, half stitch needle locations can be detected according to a simple process of setting an orthogonal coordinate system and referencing a component of the coordinate axis (Yi+1) and the direction of the axis (directional flag V). As a result, production costs of the device can be reduced, while the processing speed can be increased. Further, since the threshold value m is sot to a suitable value in S77, half stitches can be detected accurately. Since the coordinate system is set while ignoring half stitch needle locations in S95, detection of remaining half stitches in even more accurate.

In the embodiment described above, half stitch detection is performed according to the sewing order, but the detection process can also be performed in the reverse direction. Performing this process also in the reverse direction will be described next.

Figure 12:
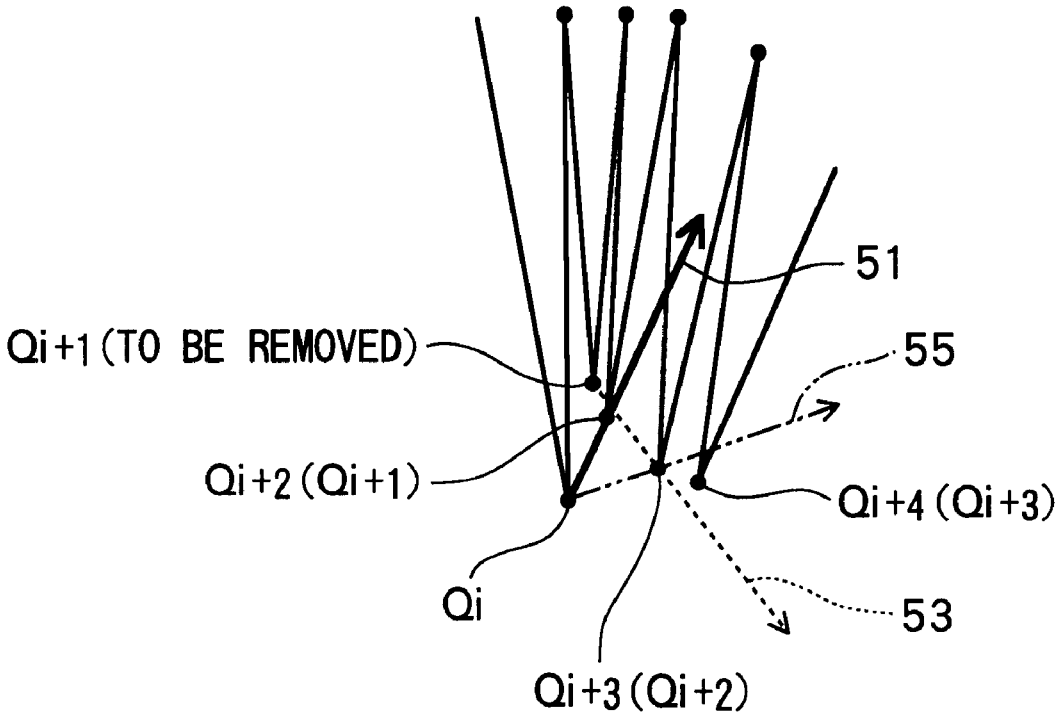
FIG. 12 is an explanatory diagram showing effects of change of annex of stitch points.
Figure 14:
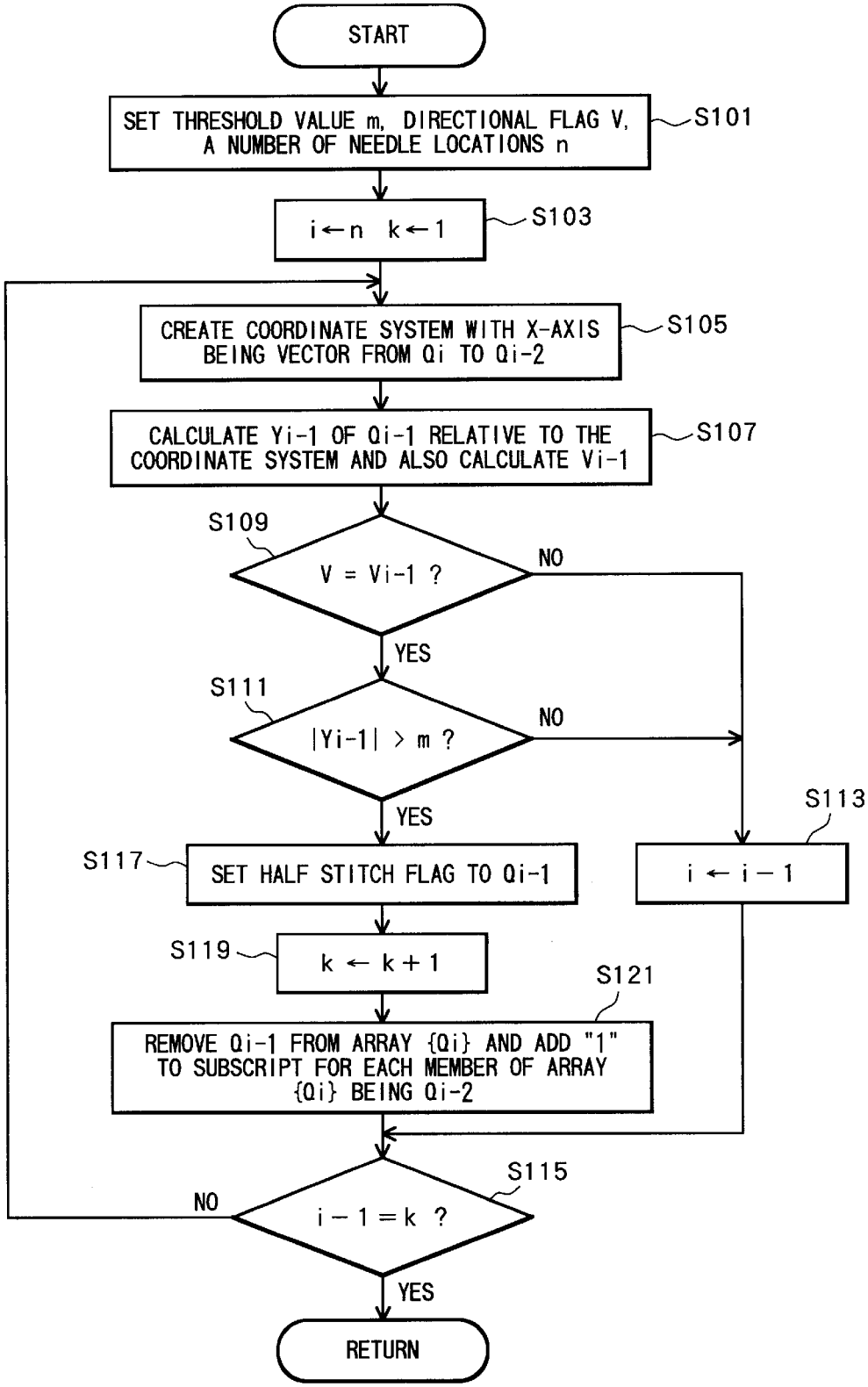
FIG. 14 is a flowchart showing a reverse-directional half stitch flag setting routine.

In this case, the process shown in FIG. 14 is executed following the process of FIG. 9 when performing the half stitch flag setting process of S75 and S96. Since only the direction of the detection processes in FIGS. 7 and 12 are different, only the points of difference will be described. Further, when the process of FIG. 14 begins, the array {Qi} has been returned to the state before changes were made in S95.

At the beginning of FIG. 14, as in FIG. 9, the threshold value m, directional flag V, and number of needle locations n are set in S101. Next, i is set to the number of needle locations n, and a variable k is set to 1 in S103. In the process of FIG. 9, the value of n is decremented by 1 in S94 each time a half stitch needle location is detected. In other words, the maximum point for the variable i is modified. In the present routine, however, the starting point of the variable i must be modifiod every time a half stitch needle location is detected. The variable k represents this starting point. Accordingly, k is set to 1 at the beginning of the process.

In S105, an orthogonal coordinate system is set with the X-axis being a vector from Qi to Qi−2, opposite the direction used in FIG. 9. S107–S111 are similar to the process of FIG. 9. The directional flag Vi−1 and the Y component Yi−1 are calculated in S107 for the needle location Qi−1. These values are compared with the directional flag V and the threshold value m in S109 and S111 to determine whether the needle location Qi−1 is a half stitch. When Qi−1 is not a half stitch ("no" in either S109 or S111, i is decreased by 1 in S113, and the process is repeated from S105 an long as i−1 does not equal k ("no" in S115).

When the needle location Qi−1 is a half stitch ("yes" in both S109 and S111), a half stitch flag is set for the needle location Qi−1 in S117, and k is incremented by 1 in S119. In S121, the needle location Qi−1 is removed from the array {Qi}, and the subscripts of all needle locations before and including Qi−2 are increased by 1. In other words, . . . , Qi−3, and Qi−2 become . . . , Qi−2, Qi−1. When i−1 equals k ("yes" in S115), control returns to the process of FIG. 6.

Figure 15:
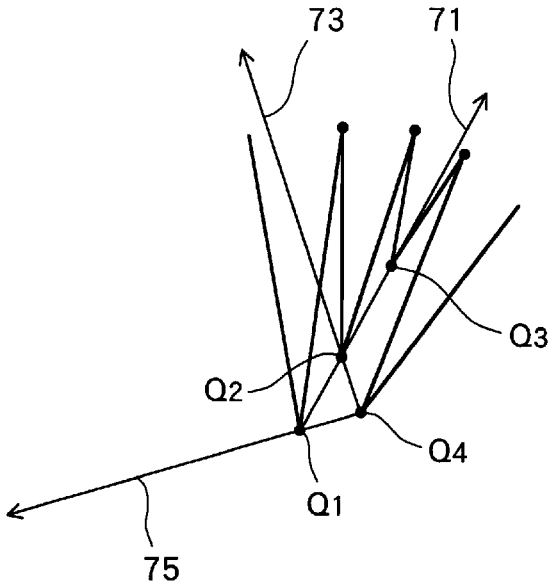
FIG. 15 is an explanatory diagram illustrating effects of the bi-directional half stitch detection.
Figure 16:
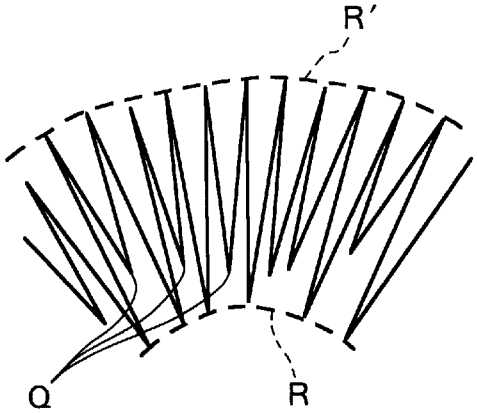
FIG. 16 (a) PRIOR ART
FIG. 16(*a*) is an explanatory diagram illustrating problems involved in a prior art.
Figure 16:
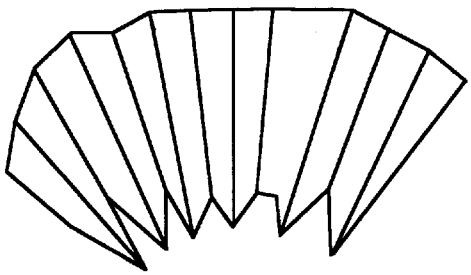
FIG. 16 (b) PRIOR ART

With the process described above, half stitches can be detected in the reverse direction, that is, the direction opposite to that used in FIG. 9. Next, the effects of the process will be described. As shown in FIG. 15, half stitch needle locations Q2 and Q3 exist in succession. When the needle locations Q1, Q2, and Q3 are arranged in a near straight line because Q3 is deep inside, the needle location Q2 cannot be detected as a half stitch if an X-axis 71 is set based on the vector from Q1 to Q3 in S81. In contrast, when the half stitch detection process is performed in the reverse direction, an X-axis 73 is set according to a vector from Q4 to Q2 in S105. Using this X-axis 73, the needle location Q3 is detected as a half stitch in S117. Next, an X-axis 75 is set based on a vector from Q4 to Q1 in S105. Using this X-axis 75, it is possible to detect the needle location Q2 as a half stitch in S117.

By performing the half stitch detection process in both ways as described above, it is possible to detect all half stitch needle locations in almost every case, even when a plurality of adjacent needle locations are half stitches. Accordingly, it is possible to detect halt stitch needle locations with increased accuracy and to create more desirable block data.

The embroidery data processing device of the present invention can also be incorporated within the sewing machine itself. Further, in addition to the process for creating block data, the present invention can be used in various other applications that require a process for detecting half stitches.

While exemplary embodiments of this invention have been described in detail, those skilled in the art will recognize that there are many possible modifications and variations which may be may in these exemplary embodiments while yet retaining many of the novel features and advantages of the invention. Accordingly, all such modifications and variations are intended to be included within the scope of the appended claims.

What is claimed is:

1. An embroidery data processing device comprising:

orthogonal coordinate system setting means for setting an orthogonal coordinate system having an X axis defined by a line formed from a needle location Pi to a needle location Pi+1 and a Y axis orthogonal to the X axis, the needle location Pi being set as an origin of the orthogonal coordinate system, i being a natural number;

comparison means for comparing an X component on the orthogonal coordinate system of the needle location Pi+1 with an X component on the orthogonal coordinate system of a needle location Pi+2; and needle location discriminating means for determining the needle location Pi+1 to be a contour point forming a contour of an embroidery pattern when comparison results indicate that the X component of the needle location Pi+1 is larger than the X component of the needle location Pi+2 wherein the embroidery pattern is sewn by sequentially numbered needle points being consecutively stitched by a thread.

2. The embroidery data processing device according to claim 1, wherein the embroidery pattern is formed based on embroidery data containing positional data of each needle position.

3. The embroidery data processing device according to claim 2, wherein setting of the orthogonal coordinate system by said orthogonal coordinate system setting means, comparison by said comparison means, and determination by said needle location discriminating means are repeatedly performed while increasing the natural number i up to a predetermined natural number th defined by the embroidery data to form the contour.

4. The embroidery data processing device according to claim 3, further comprising display means for displaying the contour.

5. The embroidery data processing device according to claim 3, wherein when said needle location discriminating means determines that the needle location Pi and the needle location Pi+2 are the contour points when the needle location Pi+1 is determined to be the contour point, said needle location discriminating means determines that the needle location Pi+1 has a satin attribute.

6. The embroidery data processing device according to claim 3, wherein when said needle location discriminating means determines that either the needle location Pi or the needle location Pi+2 is not a contour point when the needle location Pi+1 is determined to be the contour point, said needle location discriminating means determines that the needle location Pi+1 has a tatami attribute.

7. The embroidery data processing device according to claim 1, further comprising:

Y component computing means for computing a Y component of the needle location Pi+2 on the orthogonal coordinate system used for determining if the needle location Pi+1 is the contour point; and discrimination correcting means for correcting the determination made by the said needle location discriminating means so that the needle location Pi+1 having been determined as the contour point is not the contour point when a sign of the Y component of the needle location Pi+2 computed by said Y component computing means is in coincidence with at least a sign of a Y component of at least one adjacent needle location which has been determined as the contour point.

8. The embroidery data processing device according to claim 1, further comprising block forming means for forming block shapes representative of the contour of the embroidery pattern, each of the block shapes having two opposing sides, each of the two opposing sides being defined by connecting every other contour points with a line segment.

9. The embroidery data processing device according to claim 7, further comprising block forming means for forming block shapes representative of the contour of the embroidery pattern, each of the block shapes having two opposing sides, each of the two opposing sides being defined by connecting every other contour point which remains as a result of correction by said discrimination correcting means with a line segment.

10. The embroidery data processing device according to claim 9, further comprising:

thread density calculating means for calculating a thread density around each needle location; and needle location classifying means for classifying the needle locations according to the thread density, wherein said block forming means forms a block shape according to the needle locations falling into the same classification.

11. An embroidery data processing device comprising:

line setting means for setting a first line connecting an i-th needle location and an (i+4)th needle location and a second line connecting an (i+1)th needle location and an (i+3)th needle location, consecutively numbered needle locations forming a zig-zag pattern when sequentially connected by line segments where i is a natural number; and half stitch determining means for determining that an (i+2)th needle location is a half stitch needle location when the (i+2)th needle location is inside an area defined by the first line and the second line.

12. The embroidery data processing device according to claim 11, wherein said half stitch determining means determines that the(i+2)th needle location is the half stitch needle location only when the (i+2)th needle location is apart by a predetermined distance from the first line.

13. The embroidery data processing device according to claim 12, wherein the predetermined distance is determined based on a thread density of the embroidery.

14. The embroidery data processing device according to claim 12, wherein the predetermined distance is determined based on a line shape formed by connecting needle locations around the (i+2)th needle location.

15. The embroidery data processing device according to claim 12, further comprising:

orthogonal coordinate system setting means for setting an orthogonal coordinate system having an X axis defined by a line formed from the i-th needle location to the (i+4)th needle location and a Y axis orthogonal to the X axis, the i-th needle position being set as an origin of the orthogonal coordinate system;

Y component computing means for computing a Y component of (i+2)th needle location on the orthogonal coordinate system set by said orthogonal coordinate system setting means; and direction determining means for determining whether or not a direction in which the Y axis extends is toward the (i+1)th needle location or the (i+3)th needle location, wherein said half stitch determining means determines whether the (i+2)th needle location in the half stitch needle location or not based on the Y component computed by said Y component computing means and the determination made by said direction determining means.

16. The embroidery data processing device according to claim 15, wherein said half stitch determining means determines that the (i+2)th needle location is the half stitch needle location when the Y component computed by said Y component computing means is a positive value and a direction in which the Y axis extends is toward the (i+1)th needle location or (i+3)th needle location.

17. The embroidery data processing device according to claim 15, wherein said half stitch determining means determines that the (i+2)th needle location in the half stitch needle location when the Y component computed by said Y component computing means is a negative value and a direction in which the Y axis extends is away from the (i+1)th needle location or (i+3)th needle location.

18. The embroidery data processing device according to claim 11, wherein said line setting means comprises:

first line setting means for setting the first line while incrementing the natural number i by two, wherein when the i-th needle location has been determined as a half stitch needle location by said half stitch determining means, the first line is set using an (i−2k)th needle location instead of the i-th needle location wherein the (i−2k)th needle location is a firstly appearing contour point when observing the needle locations in a backwards direction while decrementing i by two, k being a natural number;

second line setting means for setting the first line while decrementing the natural number i by two, wherein when the (i+4)th needle location has been determined as the half stitch needle location by said half stitch determining means, the first line is set using an (i+4+2k)th needle location instead of the (i+4)th needle location wherein the (i+4+2k)th needle location is a firstly appearing contour point when observing the needle locations in a forward direction while incrementing i by two, wherein said half stitch determining means determines that the (i+2)th needle location is the half stitch needle location when the (i+2)th needle location is inside an area defined by the first line set by either said first line setting means or said second line setting means and the second line connecting the (i+1)th needle location and the (i+3)th needle location.

19. A method of processing embroidery data, comprising the steps of:

(a) setting an orthogonal coordinate system having an X axis defined by a line formed from a needle location Pi to a needle location Pi+1 and a Y axis orthogonal to the X axis, the needle location Pi being set as an origin of the orthogonal coordinate system, i being a natural number;

(b) comparing an X component on the orthogonal coordinate system of the needle location Pi+1 with an X component on the orthogonal coordinate system of a needle location Pi+2; and (c) determining the needle location Pi+1 to be a contour point forming a contour of an embroidery pattern when comparison results indicate that the X component of the needle location Pi+1 is larger than the X component of the needle location Pi+2, the embroidery pattern being sewn when sequentially numbered needle points are consecutively stitched by a thread.

20. The method according to claim 19, wherein the embroidery pattern is formed based on embroidery data containing positional data of each needle position.

21. The method according to claim 20, wherein steps (a), (b) and (c) are repeatedly performed while increasing the natural number n up to a predetermined natural number defined by the embroidery data to form the contour.

22. The method according to claim 21, further comprising the step of (d) displaying the contour.

23. The method according to claim 21, wherein when the needle location Pi and the needle location Pi+2 are also determined to be the contour points when the needle location Pi+1 is determined to be the contour point, the needle location Pi+1 is determined to have a satin attribute.

24. The method according to claim 21, wherein when either the needle location Pi or the needle location Pi+2 is determined not to be a contour point when the needle location Pi+1 is determined to be the contour point, the needle location Pi+1 is determined to have a tatami attribute.

25. The method according to claim 19, further comprising the step of:

(e) computing a Y component of the needle location Pi+2 on the orthogonal coordinate system used for determining if the needle location Pi+1 is the contour point; and (f) correcting the determination made in step (c) so that the needle location Pi+1 having been determined as the contour point is not the contour point when a sign of the Y component of the needle location Pi+2 computed in step (e) is in coincidence with at least a sign of a Y component of at least one adjacent needle location that has been determined as the contour point in step (c).

26. The method according to claim 19, further comprising the step of (g) forming block shapes representative of the contour of the embroidery pattern, each of the block shapes having two opposing sides, each of the two opposing sides being defined by connecting every other contour points with a line segment.

27. The method according to claim 25, further comprising the step of (h) forming block shapes representative of the contour of the embroidery pattern, each of the block shapes having two opposing sides, each of the two opposing sides being defined by connecting every other contour points which remain as a result of correction in stop (f) with a line segment.

28. The method according to claim 27, further comprising the steps of:

(i) calculating a thread density around each needle location; and (j) classifying the needle locations according to the thread density, wherein a block shape is formed according to the needle locations falling into the same classification.

29. A method of processing embroidery data, comprising the steps of:

(a) setting a first line connecting an i-th needle location and an (i+4)th needle location and a second line connecting an (i+1)th needle location and an (i+3)th needle location, consecutively numbered needle locations forming a zig-zag pattern when sequentially connected by line segments where i is a natural number; and (b) determining that an (i+2)th needle location is a half stitch needle location when the (i+2)th needle location is inside an area defined by the first line and a second line connecting an (i+1)th needle location and the (i+3)th needle location.

30. The method according to claim 29, wherein the (i+2)th needle location is determined to be the half stitch needle location only when the (i+2)th needle location is apart by a predetermined distance from the first line.

31. The method according to claim 30, wherein the predetermined distance is determined based on a thread density of the embroidery.

32. The method according to claim 30, wherein the predetermined distance is determined based on a line shape formed by connecting needle locations around the (i+2)th needle location.

33. The method according to claim 30, further comprising the steps of:

(c) setting an orthogonal coordinate system having an X axis defined by a line formed from the i-th needle location to the (i+4)th needle location and a Y axis orthogonal to the X axis, the i-th needle position being set as an origin of the orthogonal coordinate system;

(d) computing a Y component of (i+2)th needle location on the orthogonal coordinate system set in step (c); and (e) determining whether or not a direction in which the Y axis extends is toward the (i+1)th needle location or (i+3)th needle location, wherein whether the (i+2)th needle location is the half stitch needle location or not is determined based on the Y component computed in step (d) and the determination made in step (e).

34. The method according to claim 33, wherein the (i+2)th needle location is determined to be the half stitch needle location when the Y component computed in step (d) is a positive value and a direction in which the Y axis extends is toward the (i+1)th needle location or (i+3)th needle location.

35. The method according to claim 33, wherein the (i+2)th needle location is determined to be the half stitch needle location when the Y component computed in step (d) is a negative value and a direction in which the Y axis extends is away from the (i+1)th needle location or (i+3)th needle location.

36. The method according to claim 29, wherein step (a) comprises the steps of:

(a1) setting the first line while incrementing the natural number i by two, wherein when the i-th needle location has been determined as the half stitch needle location in step (b), the first line is set using an (i−2k)th needle location instead of the i-th needle location wherein the (i−2k)th needle position is a firstly appearing contour point when observing the needle locations in a backwards direction while decrementing i by two, k being a natural number;

(a2) setting the first line while decrementing the natural number i by two, wherein the (i+4)th needle location has been determined as the half stitch needle location in step (b), the first line is set using an (i+4+2k)th needle location instead of the (i+4)th needle location wherein the (i+4+2k)th needle location is a firstly appearing contour point when observing the needle locations in a forward direction while incrementing i by two, wherein the (i+2)th needle location is determined to be the half stitch needle location when the (i+2)th needle location is inside an area defined by the first line set either in step (a1) or in step (a2) and the second line connecting the (i+1)th needle location and the (i+3)th needle location.

37. The embroidery data processing device according to claim 1, wherein the needle location discriminating means determines the needle location Pi+1 to be a run point when comparison results indicate that the X component of the needle location Pi+1 is equal to or smaller than the X component of the needle location Pi+2.

38. The method according to claim 27, further comprising the steps of:

(k) setting a first line connecting an i-th contour point and an (i+4)th contour point, and a second line connecting an (i+1)th contour point and an (i+3)th contour point, consecutively numbered contour points forming a zig-zag pattern when sequentially connected by the line segments; and (l) correcting that an (i+2)th contour point is not a contour point but a half stitch needle location when the (i+2)th needle location is located between the first line and the second line.

* * * * *